US007071954B2

(12) United States Patent
Takahashi

(10) Patent No.: US 7,071,954 B2
(45) Date of Patent: Jul. 4, 2006

(54) DISPLAY DEVICE

(75) Inventor: Yasunori Takahashi, Tokyo (JP)

(73) Assignee: Pioneer Plasma Display Corporation, Kagoshima Prefecture (JP)

( * ) Notice: Subject to any disclaimer, the term of this patent is extended or adjusted under 35 U.S.C. 154(b) by 598 days.

(21) Appl. No.: 09/867,098

(22) Filed: May 29, 2001

(65) Prior Publication Data

US 2002/0015010 A1 Feb. 7, 2002

(30) Foreign Application Priority Data

May 30, 2000 (JP) ..... 2000-164793

(51) Int. Cl.
*G09G 5/10* (2006.01)

(52) U.S. Cl. ..... 345/690; 345/596; 358/1.9

(58) Field of Classification Search ..... 345/690, 345/204, 89, 616, 613, 596; 358/445, 3.03, 358/3.06, 1.9, 2.1
See application file for complete search history.

(56) References Cited

U.S. PATENT DOCUMENTS 5,014,333 A * 5/1991 Miller et al. ..... 382/252
5,229,762 A 7/1993 Itoh et al. ..... 340/793
5,245,444 A * 9/1993 Hashimoto ..... 358/445
5,394,250 A * 2/1995 Shono ..... 358/3.03
5,448,260 A 9/1995 Zenda et al. ..... 345/100
5,808,628 A * 9/1998 Hinson et al. ..... 345/547
5,838,336 A 11/1998 Ross ..... 345/508
5,920,646 A * 7/1999 Kamon ..... 382/173
6,388,678 B1 * 5/2002 Kasahara et al. ..... 345/690

FOREIGN PATENT DOCUMENTS

| | | |
|---|---|---|
| JP | 2-266966 | 10/1990 |
| JP | 07-140923 | 2/1995 |
| JP | 7-87316 | 3/1995 |
| JP | 7-087316 | 3/1995 |
| JP | 9-185340 | 7/1997 |

* cited by examiner

*Primary Examiner*—Kent Chang
(74) *Attorney, Agent, or Firm*—Drinker Biddle & Reath LLP

(57) ABSTRACT

A gradation circuit is provided with an error diffusion circuit, a dither pattern circuit and a switch. The error diffusion circuit converts a digital signal into a signal indicative of a level of gradation by an error diffusion method. The dither pattern circuit converts a digital signal into a signal indicative of a level of gradation by a dithering method. The switch selects for output between an output signal of the error diffusion circuit and an output signal of the dither patter circuit as on output signal of the gradation circuit.

15 Claims, 2 Drawing Sheets

DISPLAY DEVICE

BACKGROUND OF THE INVENTION

1. Field of the Invention

The present invention relates to a display device, such as a plasma display device, which displays pseudo gradation images, and more particularly to a display device which can receive both analog and digital image signals.

2. Description of the Related Art

For example, a digital printer for printing out a gray scale image such as a photograph and painting requires the conversion of a multi-value image signal, inputted from a device such as a scanner or computer for outputting image data, into a signal indicative of gradation in order to support the number of gradation levels of the image print-out mechanism of the printer. Known as a conversion technique mentioned above is the error diffusion technique and the dithering technique.

For example, a variable print-quality digital printer for expressing gradation in a pseudo manner through conversion by the dithering technique is disclosed in Japanese Patent Laid-Open Publication No. Hei 2-266966. The printer disclosed in this publication is adapted to make it possible for a user to select as appropriate between an 8×8 or 4×4 matrix for performing gradation processing, in accordance with the type of the image to be printed out.

In addition, the types of images to be printed out include a character and picture image. If the image to be printed out includes only a character image and the user has selected the 4×4 matrix for performing gradation processing by dithering, the 4×4 matrix would provide less levels of gradation but a higher resolution in the processing than the 8×8 matrix. This allows the character to be printed out clearly. In contrast, if the image to be printed out includes only a picture image and the user has selected the 8×8 matrix for performing gradation processing by dithering, the 8×8 matrix would provide a lower resolution but more levels of gradation in the processing than the 4×4 matrix. This allows a picture smooth in quality to be printed out. Now, suppose the image to be printed out includes both a character and picture image and the user has selected the 8×8 matrix for performing gradation processing by dithering, just as in the case of printing out an image that includes only a picture image. This would provide an image of poorer image quality but of a more balanced character and picture than the cases where the character or picture is independently processed.

In the foregoing, the display device receives mainly an analog signal as the input signal. However, recent years have seen widespread use of displays such as the liquid crystal display and the plasma display, which receive a digital signal as the input signal. If an analog signal is received as the input signal, an analog signal of the RGB color space is also handled even when the display device receives an image signal from a computer. However, recent high-speed transmission technology involves direct input and output of a digital signal between the computer and the display device.

When an analog signal is inputted into the display device as an image signal, the input analog signal is converted into a digital signal by means of an analog-to-digital (A/D) converter. The digital signal outputted from the analog-to-digital converter is subjected to predetermined processing in a picture signal processor. Then, the digital signal is converted by a gradation circuit into a signal indicative of a level of pseudo gradation to support the number of levels of gradation of the display panel. The gradation circuit performs error diffusion processing on the digital signal. In the error diffusion processing, the image signal to be processed is converted to reduce the number of bits thereof, and a quantization error produced upon the conversion is added for diffusion to an image signal to be subsequently processed.

However, there exists noise in the lower bits of the digital signal outputted from the A/D converter. For this reason, when the error diffusion processing is performed in the gradation circuit, the noise acts in the same manner as random numbers. This would cause the error diffusion processing to produce further irregular patterns.

In contrast, when the display device receives directly a digital signal as an image signal, unlike the case of receiving an analog signal, no noise exists in the lower bits of the digital signal. Thus, when image signals of a uniform level of gray scale are inputted successively, this causes a cyclic pattern to be produced after the error diffusion processing has been performed in the gradation circuit.

The pattern to be produced after the error diffusion processing depends on the quantization error of the source of diffusion. Thus, in some cases, this makes it impossible to specify what kind of pattern to be produced, causing the image quality to deteriorate depending on the condition.

Therefore, a digital signal, which has no noise in the lower bits, inputted as an image signal makes it possible to generate a stable pattern by the dithering method when selected as the gradation processing. This therefore ensures the quality of the image.

SUMMARY OF THE INVENTION

It is therefore an object of the present invention to provide a display device which allows a user to select as appropriate between the error diffusion method and the dithering method as a gradation conversion method in accordance with the format of the input image signal, and which can display a pseudo gradation to the characteristics of the input image signal.

According to the present invention, a display device comprises a first input terminal which receives an analog image signal, a second input terminal which receives a digital image signal, an analog-to-digital converter connected to the first input terminal, a first switch which selects for output between a digital signal outputted from the analog-to-digital converter and a digital signal inputted to the second input terminal, and a gradation circuit which converts a digital signal outputted from the first switch into a signal indicative of a level of pseudo gradation. The gradation circuit comprises an error diffusion circuit which converts the digital signal outputted from the first switch into a signal indicative of a level of pseudo gradation by an error diffusion method, a dither pattern circuit which converts the digital signal outputted from the first switch into a signal indicative of a level of pseudo gradation by a dithering method, and a second switch which selects for output between an output signal of the error diffusion circuit and an output signal of the dither patter circuit.

The present invention can provide an optimum level of gradation expressed in agreement with the type of an input signal.

Furthermore, with the gradation circuit being provided with a switch controller, it is made possible to automatically select the method for converting levels of gradation between the error diffusion method and the dithering method.

DETAILED DESCRIPTION OF THE PREFERRED EMBODIMENT

Figure 1:
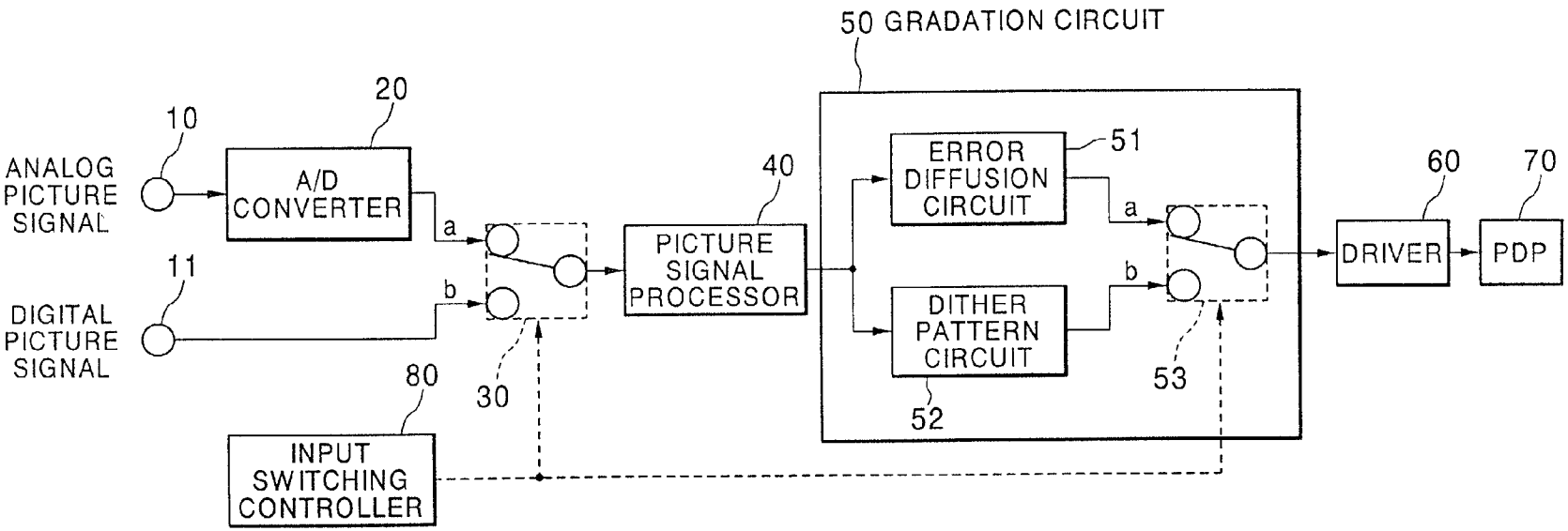
FIG. 1 is a block diagram illustrating the configuration of a display device according to a first embodiment of the present invention.

Now, preferred embodiments according to the present invention will be explained below in more detail with reference to the accompanying drawings. FIG. 1 is a block diagram illustrating the configuration of a display device according to a first embodiment of the present invention.

In the first embodiment, there are provided an analog input terminal 10 for receiving an analog image signal and a digital input terminal 11 for receiving a digital image signal. An A/D converter 20 is connected to the analog input terminal 10. The A/D converter 20 converts an analog image signal into a digital signal that is quantized in a predetermined number of bits. On the other hand, the digital image signal has already been quantized in a predetermined number of bits. There is also provided a picture signal processor 40 for performing various types of image processing on the digital signal in accordance with the output format of a plasma display panel (PDP) 70. The input terminal of the picture signal processor 40 is connected with a switch 30 for selecting a signal to be inputted to the picture signal processor 40 between the digital signal that has been inputted to a digital input terminal 11 and the digital signal that has been outputted from the A/D converter 20. For example, the switch 30 is switched by a user via an input switching controller 80. The input switching controller 80 identifies the command provided by the user to control the switching operation of the switch 30 and a switch 53 in accordance with the identified command. For example, the input switching controller 80 may be composed of a microcomputer.

The output terminal of the picture signal processor 40 is connected with a gradation circuit 50 for converting a digital signal into a signal indicative of a level of pseudo gradation. The gradation circuit 50 is provided with an error diffusion circuit 51 and a dither pattern circuit 52, to which an output signal of the picture signal processor 40 is inputted. In addition, the switch 53 is provided to select an output signal of the gradation circuit 50 between the output signal of the error diffusion circuit 51 and the output signal of the dither pattern circuit 52. For example, like the switch 30, the switch 53 is switched by the user via the input switching controller 80. Then, the gradation circuit 50 converts the image signal outputted from the picture signal processor 40 into a signal having a less number of bits for output.

A driver 60 is connected to the output terminal of the gradation circuit 50, while the PDP 70 is connected to the driver 60. The PDP 70 displays images by making use of light emission generated by the discharge phenomenon of a plasma gas being driven by the driver 60.

Now, the operation of the first embodiment configured as described above will be explained below. First, the user switches via the input switching controller 80 between the switches 30 and 50 depending on whether the image signal is an analog or a digital signal.

If the image signal is an analog signal, the A/D converter 20 converts the analog signal inputted to the analog input terminal 10 into a digital signal that is quantized in a predetermined number of bits. Then, the resulting digital signal is inputted into the picture signal processor 40 via the switch 30.

On the other hand, if the image signal is a digital signal, the digital signal inputted to the digital input terminal 11 is inputted into the picture signal processor 40 via the switch 30. Incidentally, this digital signal has already been quantized in a predetermined number of bits.

The digital signal outputted from the switch 30 is subjected to the predetermined image processing in the picture signal processor 40 and then outputted to the gradation circuit 50. Subsequently, the error diffusion circuit 51 and the dither pattern circuit 52 in the gradation circuit 50 convert the digital signal into a signal having the number of bits that is required for output in the PDP 70. More specifically, the error diffusion circuit 51 adds the quantization error, which is produced when the number of bits of a pixel is reduced, to the pixel to be subsequently processed. Thus, the error diffusion circuit 51 diffuses the quantization error to generate a pattern of a level of pseudo gradation. On the other hand, the dither pattern circuit 52 performs threshold processing by the use of a dither matrix on the digital signal inputted from the picture signal processor 40 to thereby generate a regular tile pattern.

As described above, the user switches the switch 53 depending on whether the image signal inputted into the display device is an analog or a digital signal. When the image signal is an analog signal, the signal that has been converted by the error diffusion circuit 51 into a level of pseudo gradation is outputted from the switch 53 as an output signal of the gradation circuit 50. On the other hand, when the image signal is a digital signal, the signal that has been converted by the dither pattern circuit 52 into a level of pseudo gradation is outputted from the switch 53 as an output signal of the gradation circuit 50.

The digital signal outputted with the number of bits thereof having been reduced by the gradation circuit 50 is inputted into the driver 60. The driver 60 drives the PDP 70 to allow the level of pseudo gradation to appear thereon.

In the first embodiment configured as described above, the user may switch between the switches 30 and 50 via the input switching controller 80 upon switching the inputted image signal between the analog and digital signal. For example, this switching can be carried out through the operation of a remote controller.

Figure 2:
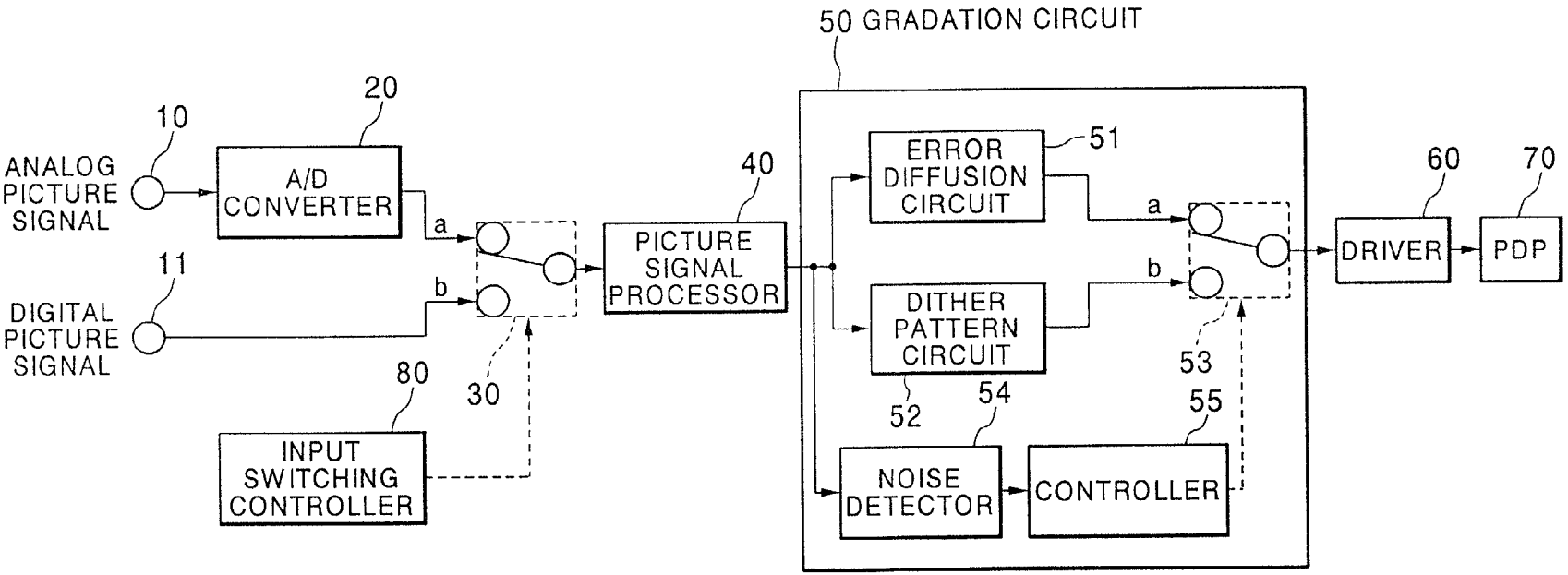
FIG. 2 is a block diagram illustrating the configuration of a display device according to a second embodiment of the present invention.

Now, a second embodiment of the present invention will be explained below. FIG. 2 is a block diagram illustrating the configuration of a display device according to a second embodiment of the present invention.

In the second embodiment, the gradation circuit 50 is provided with a noise detector 54 for detecting whether noise exists in the lower bits of the digital signal that has been outputted from the picture signal processor 40. The gradation circuit 50 is also provided with a controller 55 for controlling the switching operation of the switch 53 in accordance with the result of detection by the noise detector 54. The operation of the switch 30 is controlled by means of the input switching controller 80, whereas the operation of the switch 53 is not controlled by means of the input switching controller 80.

Now, the operation of the second embodiment configured as described above will be explained below.

When an image signal is an analog signal, the lower bits of the output signal of the picture signal processor 40 contain noise. In such a case, the noise detector 54 detects the noise and then outputs the result of detection (indicative of the presence of noise) to the controller 55. The controller 55 switches the switch 53 to the side of the error diffusion circuit 51 (to side "a" in FIG. 2). This causes a signal that has been converted into a level of pseudo gradation by the error diffusion circuit 51 to be outputted from the switch 53 as an output signal of the gradation circuit 50.

On the other hand, when the image signal is a digital signal, the lower bits of the output signal of the picture signal processor 40 include no noise. In this case, the noise detector 54 outputs the result of detection indicative of the absence of noise to the controller 55. The controller 55 switches the switch 53 to the side of the dither pattern circuit 52 (to side "b" in FIG. 2). This causes a signal that has been converted into a level of pseudo gradation by the dither pattern circuit 52 to be outputted from the switch 53 as an output signal of the gradation circuit 50.

In the second embodiment configured as described above, it is determined automatically in the gradation circuit 50 whether the input signal to the display device is an analog signal or a digital signal. Accordingly, the output signal of the gradation circuit 50 is subjected to the gradation processing corresponding to the input signal.

Incidentally, these embodiments employ a plasma display panel as the image display portion, however, the present invention is not limited thereto. The present invention can also be applied to any display such as a liquid crystal display panel or an electro-luminescence display panel so long as the display can receive an analog and a digital signal as the input signal.

What is claimed is:

1. A display device comprising:

a first input terminal for receiving an analog image signal;

a second input terminal for receiving a digital image signal;

an analog-to-digital converter connected to said first input terminal;

a first switch for selecting an output between a digital signal outputted from said analog-to-digital converter and a digital signal inputted to said second input terminal; and a gradation circuit for converting a digital signal outputted from said first switch into a signal indicative of a level of pseudo gradation, said gradation circuit comprising:

an error diffusion circuit for converting said digital signal outputted from said first switch into a signal indicative of a level of pseudo gradation by an error diffusion method;

a dither pattern circuit for converting said digital signal outputted from said first switch into a signal indicative of a level of pseudo gradation by a dithering method; and a second switch for converting for output between an output signal of said error diffusion circuit and an output signal of said dither pattern circuit.

2. The display device according to claim 1, wherein said first switch is operatively switched by a user.

3. The display device according to claim 1, wherein said second switch is operatively switched by a user.

4. The display device according to claim 1, wherein said gradation circuit comprises a noise detector for detecting noise of an output signal of said first switch, and a switch controller for controlling said second switch in accordance with a result of detection by said noise detector.

5. The display device according to claim 4, wherein said noise detector determines whether lower bits of an output signal of said first switch include noise or not.

6. The display device according to claim 5, wherein when it has been determined by said noise detector that noise is included, said switch controller causes said second switch to output an output signal of said error diffusion circuit.

7. The display device according to claim 5, wherein when it has been determined by said noise detector that noise is not included, said switch controller causes said second switch to output an output signal of said dither pattern circuit.

8. The display device according to claim 1, further comprising:

a driver for receiving an output signal of said second switch; and a display panel to be driven by said driver.

9. The display device according to claim 2, further comprising:

a driver for receiving an output signal of said second switch; and a display panel to be driven by said driver.

10. The display device according to claim 3, further comprising:

a driver for receiving an output signal of said second switch; and a display panel to be driven by said driver.

11. The display device according to claim 4, further comprising:

a driver for receiving an output signal of said second switch; and a display panel to be driven by said driver.

12. The display device according to claim 5, further comprising:

a driver for receiving an output signal of said second switch; and a display panel to be driven by said driver.

13. The display device according to claim 6, further comprising:

a driver for receiving an output signal of said second switch; and a display panel to be driven by said driver.

14. The display device according to claim 7, further comprising:

a driver for receiving an output signal of said second switch; and a display panel to be driven by said driver.

15. A video display device capable of receiving a digital video signal converted from an analog input video signal and a digital input video signal, said display comprising a gradation circuit wherein:

a pseudo intermediate gradation process can be executed in both an error diffusion method and a dithering method, and when said digital video signal converted from said analog input video signal is input, said pseudo intermediate gradation process in said error diffusion method is selected, whereas when said digital input video signal is input, said pseudo intermediate gradation process in said dithering method is selected.

* * * * *